United States Patent [19]

Macrory et al.

[11] 4,120,503

[45] Oct. 17, 1978

[54] CHASE-TYPE BOARD GAME

[76] Inventors: Richard Brabazon Macrory; Nicholas Gordon Young, both of 68 Stockwell Park Rd., London, S.W. 9, England

[21] Appl. No.: 762,924

[22] Filed: Jan. 26, 1977

[30] Foreign Application Priority Data

Feb. 3, 1976 [GB] United Kingdom ..... 4195/76

[51] Int. Cl.[2] ..... A63F 3/00

[52] U.S. Cl. ..... 273/244; 273/248; 273/290

[58] Field of Search ..... 273/134 AC, 134 D, 134 E, 273/134 C, 134 CB, 134 AD, 134 DB, 134 CA, 131 F, 131 BB, 131 AB, 131 K, 244, 248, 249; 46/22, 163

[56] References Cited

U.S. PATENT DOCUMENTS

| | | | |
|---|---|---|---|
| 1,562,025 | 11/1925 | Killman | 273/131 BB |
| 1,666,953 | 4/1928 | Tuttle et al. | 273/131 BB |
| 2,470,632 | 5/1949 | McLeod | 273/134 AC |
| 2,572,412 | 10/1951 | Wharton, Jr. | 273/137 AB |
| 2,662,335 | 12/1953 | Calverley | 46/22 |
| 3,362,715 | 1/1968 | Hartpence | 273/134 AC |
| 3,874,671 | 4/1975 | Smith | 273/134 AC |
| 4,038,775 | 8/1977 | Sato | 46/22 |

FOREIGN PATENT DOCUMENTS

| | | | |
|---|---|---|---|
| 889,265 | 9/1943 | France | 273/134 AC |
| 646,860 | 11/1950 | United Kingdom | 273/134 AD |

*Primary Examiner*—Richard C. Pinkham
*Assistant Examiner*—Harry G. Strappello
*Attorney, Agent, or Firm*—Cushman, Darby & Cushman

[57] ABSTRACT

A game is provided having a game board which represents the sea off a bathing resort. The sea is divided into a number of playing spaces each of which are differently numbered. At one end of the board is a large home beach where players are safe and out at sea are four airbeds from which play is started. There are five playing pieces one in the form of a shark and four in the form of swimmers: Each of the swimmers has two removable legs. Several of the playing spaces are chance positions and the game includes two chance cards bearing adverse or favorable instructions respectively. The instructions are in the form of cartoons.

3 Claims, 6 Drawing Figures

CHASE-TYPE BOARD GAME

FIELD OF THE INVENTION

This invention relates to a game.

SUMMARY OF THE INVENTION

According to the present invention a game comprises a playing surface at least part of which is representative of a water area, said water area being divided into a plurality of playing spaces, a marking on each playing space which distinguishes one playing space from another playing space, a playing member representative of a shark, and a plurality of playing members representative of swimmers, each swimmer playing member including a detachable portion.

In accordance with another aspect of the invention a game comprises a playing surface substantially as shown in the accompanying drawing, a playing member representative of a shark, a plurality of playing members representative of swimmers each of which include a body portion and two detachable limbs, two chance cards one of which carries a plurality of different instructions adversely affecting a player's progress in a game and the other of which carries a plurality of different instructions favourably affecting a player's progress in a game, and two dice one of which bears only two different markings denoting either the adverse chance card or the favourable chance card and the other of the dice including a plurality of different markings corresponding to the number of different instructions carried by the chance cards.

The invention also includes a plurality of playing pieces each in the form of a model swimmer having removable legs, a different playing piece representative of a shark, a playing surface divided into at least two areas one representative of sea and the other representative of land, a plurality of playing spaces on that part of the playing surface representative of sea, each playing space being individually identifiable by a different character reference and chance instructions affecting a player's progress in a game.

More particularly it is preferable that:

(a) the different playing piece representative of a shark be in the form of a model shark;

(b) the playing spaces are each individually identifiable by a different number that each space carries. Alternatively, if the spaces are rectangular, each space may have a grid reference, the playing surface having numbers or letter down two sides so that each space has a different grid reference; and (c) the playing spaces are each of hexagonal shape.

BRIEF DESCRIPTION OF THE DRAWINGS

The invention will now be described in more detail by way of example with reference to the accompanying drawings in which.

DESCRIPTION OF THE PREFERRED EMBODIMENT

The game is a game of chase between four swimmers and a shark. The shark is trying to catch the swimmers, eat them or at least bite off their legs whereas the swimmers are trying to swim across the board, evading the shark's attacks and reach the safety of the home beach on the other side. One player must be the shark and the remaining players the swimmers differentiated by coloured swimming costumes.

Figure 3:
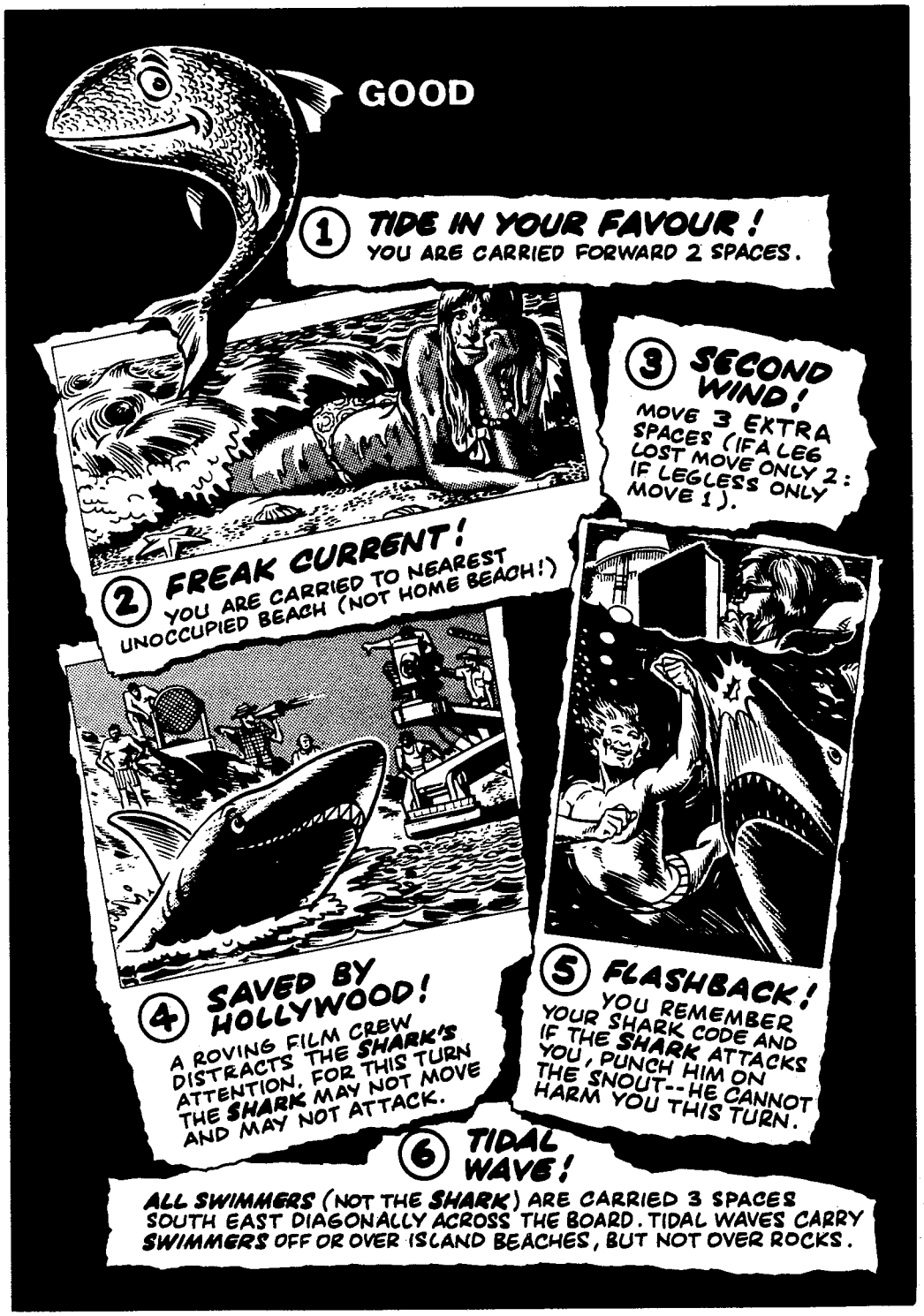
FIGS. 3 and 4 illustrate the chance instruction cards.
Figure 4:
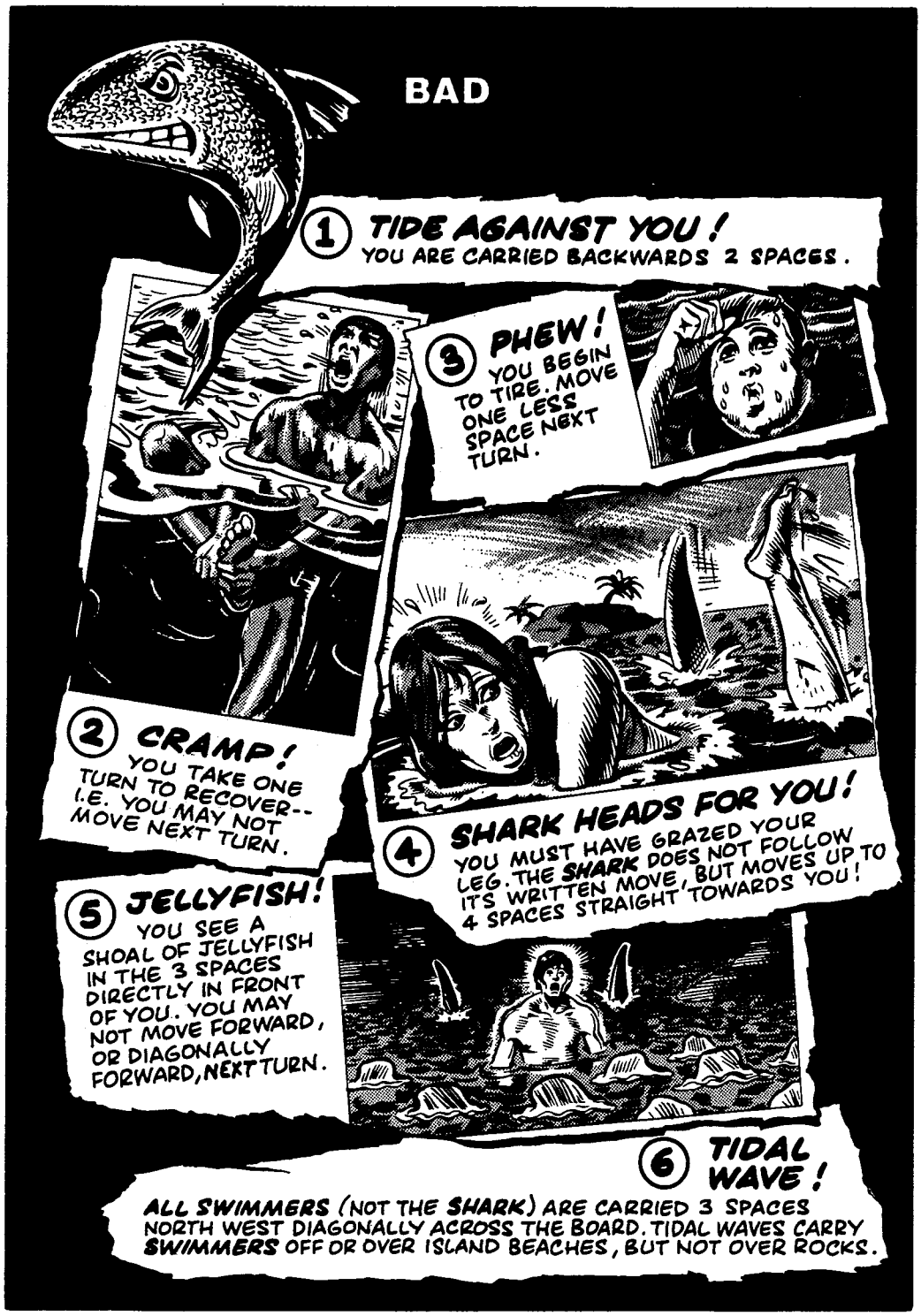
Figure 5:
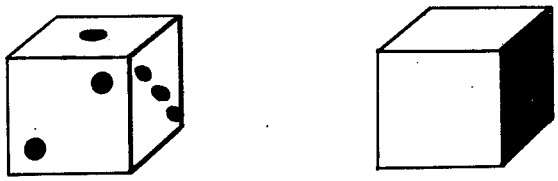
FIGS. 5 and 6 illustrate two dice and a shark playing token respectively.

The playing surface 1, preferably a board, represents an area of sea off a bathing resort, and is marked off in numbered hexagonals. The areas 2 represent rocks; the different shaded areas 3 represent beaches; and the wavy lines 4 represent shark nets. In the area representative of sea there are also four airbeds 5 which form 'start' positions for the swimmers and a number of chance playing spaces designated by Red Herrings 6. A chance is taken by using two dice one of which has faces bearing either red or black denoting the adverse chance card and the favourable chance card respectively. The other dice is a spot dice numbered from one to six see FIG. 5 for an illustration of the two dice. The two chance cards illustrated in FIGS. 3 and 4 both have six different instructions, the instruction effected being determined by the number of the spot dice. The instructions on each card are preferably in the form of six captioned cartoons usually affecting the movement of a swimmer e.g. "cramp! you take one turn to recover i.e. you may not move next turn" is one adverse instruction whereas a favourable instruction may move a swimmer forward e.g. "Tide in your favour! you are carried forward two spaces". The chance cards also include instructions regarding the shark e.g. an adverse instruction is "Shark heads for you! you must have grazed your leg. The shark does not follow its written move but moves up to four spaces towards you". A favourable instruction is "Saved by Hollywood! A roving film crew distracts the shark's attention. For this turn the shark may not move and may not attack".

Figure 1:
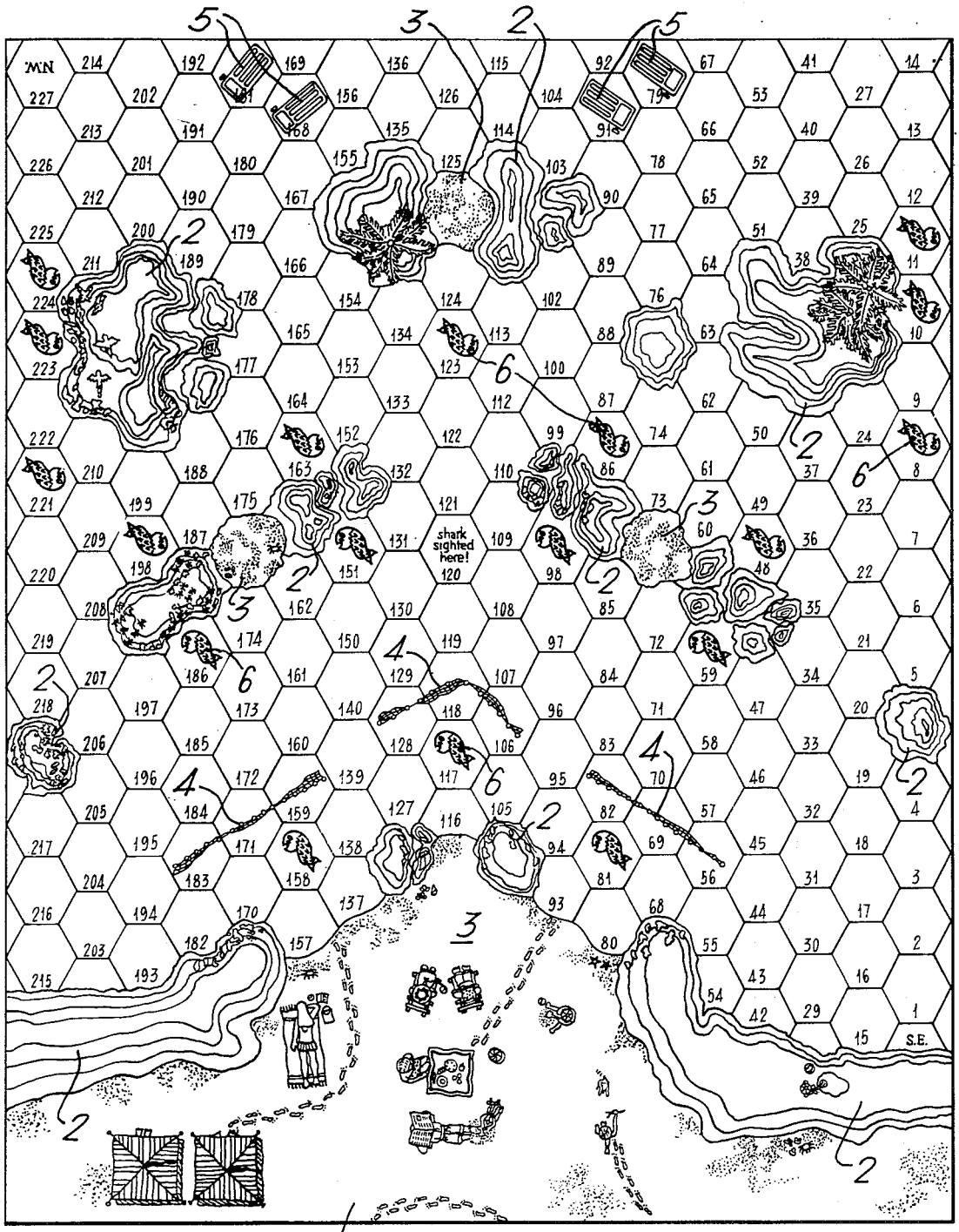
FIG. 1 illustrates a preferred form of layout for a playing surface.
Figure 2:
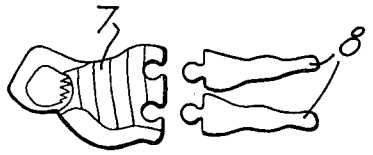
FIG. 2 illustrates a preferred form of swimmer.
Figure 6:
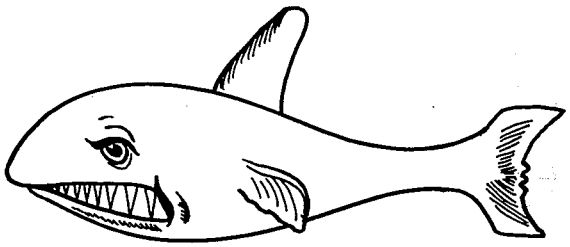

The swimmers shown in FIG. 2 have a body portion 7 and two detachable legs 8 which interlock with the body portion 7 as shown. The shark playing token may be as shown in FIG. 6.

The rules of the game will now be explained.

Movement

The shark starts on the space marked "Shark sighted here". In each turn the shark may move up to four spaces in any direction and not necessarily in a straight line. The shark need not move but may remain on his space for as many turns as he wishes.

In each turn the swimmers may move up to two spaces in any direction and not necessarily in a straight line. A swimmer may NOT "tread water", i.e. may not remain on the same space.

Order of Movement In each turn the order of movement is as follows:

First: The Shark secretly writes down the number of the space he wishes to move to. (If he decides to stay where he is, he must write that down). He has now dived under water.

Second: The Swimmers all move as they wish (even on to the space where the Shark is). They must move in order — red, green, blue, yellow — and no two Swimmers are allowed on the same space at a time.

Third: Any Swimmers who have moved on to Red Herring spaces follow the Red Herring chance procedure.

Fourth: The Shark reveals the number of the space he wrote down and must move directly to it (unless he has already been affected by a Red Herring instructing him otherwise). (If the Shark has written an impossible move — e.g. one of 5 spaces — then he cannot move or attack that turn).

This means that once the Shark has written his move, he's on the hunt — somewhere beneath the surface. The Swimmers must guess where he is about to appear, and steer clear of that space. But all the time the Shark is trying to outwit them.

Attacks

If the Shark lands on the same space as a Swimmer, he swallows him whole. The Shark removes the Swimmer from the board and keeps him as a trophy until the end of the game.

If the Shark lands on a space adjacent to a Swimmer, he removes one of his legs and keeps that as a trophy. From then on that Swimmer only may move one space per turn instead of two.

If the Shark lands on a space adjacent to a Swimmer who has already lost a leg, he removes the other leg. From then on that Swimmer will be legless and may no longer move where he wishes, but each turn will drift one space in a straight line towards the home beach end of the board. Depending on the position of the Swimmer he may drift into the safety of the home beach itself. If he drifts onto a Red Herring space he must follow the usual Red Herring procedure. But he may drift onto an island or onto rocks (in this case he is actually moved on to the rocks themselves). If that happens, he will remain there for the rest of the game and the Shark may no longer attack him.

Note:

When the Shark successfully attacks a Swimmer he may not attack that same Swimmer again during the next turn — i.e. a Swimmer always has one turn's grace after he has lost a leg.

Once a Swimmer is legless, the Shark must land on the same space in order to swallow him.

If a Shark lands on a space adjacent to two Swimmers at the same time, he may only attack one of them, and must choose which.

Red Herrings

Red Herring spaces may be moved onto by choice and therefore are for the Swimmer who wants to take a gamble. If the Shark moves onto a Red Herring space, nothing happens. But if a Swimmer moves onto one, he must follow the procedure set out below:

At the end of a turn when all the swimmers have moved but before the Shark reveals his move, roll the two dice. If the Red Herring Dice comes up black, use the Black Red Herring Card, which has the favourable instructions. If it comes up red, use the Red Card, which has the adverse instructions. The number on the spot dice denotes the instruction number on the card, which a player must follow.

Note:

'Forwards' in the instructions means in a straight line towards the home beach end of the board (not the home beach itself), and 'backwards' means towards the airbed end of the board.

Sometimes a Swimmer will find he cannot follow the instructions to move forwards or backwards because there are rocks in the way. When this happens, he must skirt round them to follow the direction as closely as possible.

But in the case of Tidal Waves, the Swimmers must move only diagonally NW or SE, and if there are rocks in the way, they must stop in front of them. Once a Swimmer has drawn a Tidal Wave no further Red Herrings may be drawn that turn.

When two or more Swimmers land on Red Herrings during the same turn, they must follow the procedure strictly in their usual order of play (red, green, blue, yellow). And if two of these Red Herrings are mutually impossible then the first to be read out takes precedence.

When a Red Herring instructs a Swimmer to stay where he is for one turn the Swimmer does not draw another Red Herring the next turn. Similarly, if a Red Herring instructs a Swimmer to move a number of spaces, and this moves him onto another Red Herring, he does not draw this second Red Herring.

Finally — when all Red Herrings for that turn have been followed — the Shark reveals his move.

Rocks, Island Beaches and Shark Nets

The rocks on the board are out of bounds to both Swimmers and the Shark.

The island beaches are out of bounds to the Shark, but not to the Swimmers. Once on an island beach a Swimmer cannot be attacked by the Shark. The Swimmer may stay for as many turns as desired, unless he is the last Swimmer left in play, in which case the swimmer may remain there for only one turn at a time. Island beaches count as one space, so only one Swimmer is allowed there at a time. Swimmers may move onto them from one side and leave from the other but not in the same turn.

The shark nets are out of bounds to the Shark, but not to the Swimmers. The Shark may never cross the shark net spaces, but must always skirt round them; the Swimmers may move freely across them. When a Swimmer is on a shark net space he therefore cannot be swallowed whole by the Shark, though he can still have a leg bitten off if the Shark lands on an adjacent space.

Swimmers may move back on to the airbed spaces, but are not safe from the Shark on them.

End Game

Once a Swimmer lands on the home beach he is safe.

When there is only one Swimmer left in play (the others having reached home, drifted onto rocks, or been eaten by the Shark), then the game may only last for 5 turns more, after which the game ends and scoring takes place.

Scoring

The Shark scores:

1 point for each leg he has removed from the board
1 point for each legless swimmer he has swallowed
3 points for each whole swimmer he has swallowed Each Swimmer scores:

3 points for reaching the home beach in one piece
2 points for reaching the home beach with only one leg
1 point for reaching the home beach legless Only Swimmers who reach the home beach score.

Contests

Several kinds of contest may be played e.g.

The Two Player Game

This game is simply a contest between the Shark and the player with the Swimmers for the highest score.

The Team Game

When there are 3 or more players, the Swimmers can all play as a team, and try to beat the Shark together. Scoring as for the Two Player Game.

The Loner Game

Each Swimmer can play a separate game against the Shark, in which case the Shark works out the score between him and each Swimmer individually. A bonus point may be awarded to the Swimmer who reaches the Home Beach first.

The Shark Game

Each player plays one game as the Shark, and only the Shark's score is recorded. At the end, the player with the most points wins.

Although the game has been particularly described with swimmers each having two detachable legs it is understood that the swimmers alternatively may have detachable arms or only one detachable body portion. The game is preferably packaged in a box and a pen and pad and instructions provided in addition to the game parts already mentioned.

What is claimed is:

1. A game comprising a playing surface at least part of which is representative of a water area, said water area being divided into a plurality of playing spaces, a marking on each playing space which distinguishes one playing space from another playing space, a playing member representative of a shark, a plurality of playing members representative of swimmers, each swimmer playing member including a detachable portion, two chance cards one of which carries a plurality of different instructions adversely affecting a player's progress in a game and the other of which carries a plurality of different instructions favorably affecting a player's progress in a game, and two dice one of which bears only two different markings denoting either the adverse chance card or the favorable chance card and the other of the dice including a plurality of different markings corresponding to the number of different instructions carried by the chance cards.

2. A game comprising a playing surface, at least part of which is representative of a water area, said water area being divided into a plurality of playing spaces, a playing member representative of a shark, a plurality of playing members representative of swimmers each of which include a body portion and two detachable limbs, two chance cards one of which carries a plurality of different instructions adversely affecting a player's progress in a game and the other of which carries a plurality of different instructions favorably affecting a player's progress in a game, and two dice one of which bears only two different markings denoting either the adverse chance card or the favorable chance card and the other of the dice including a plurality of different markings corresponding to the number of different instructions carried by the chance cards.

3. A game comprising a plurality of playing pieces each in the form of a model swimmer having removable legs, a different playing piece in the form of a shark, a playing surface divided into at least two areas one area representative of sea and the other area representative of land, a plurality of playing spaces on that part of the playing surface representative of sea, each playing space being individually identifiable by a different character reference and a plurality of different chance instructions adversely affecting a player's progress in a game, a plurality of different chance instructions favorably affecting a player's progress in a game, said chance instructions being carried on chance cards, and dice means for determining whether a player follows either an adverse chance instruction or a favorable chance instruction.

* * * * *